US007830200B2

(12) United States Patent
Rao et al.

(10) Patent No.: US 7,830,200 B2
(45) Date of Patent: Nov. 9, 2010

(54) HIGH VOLTAGE TOLERANT BIAS CIRCUIT WITH LOW VOLTAGE TRANSISTORS

(75) Inventors: T. V. Chanakya Rao, Bangalore (IN); Badrinarayanan Kothandaraman, Bangalore (IN)

(73) Assignee: Cypress Semiconductor Corporation, San Jose, CA (US)

( * ) Notice: Subject to any disclaimer, the term of this patent is extended or adjusted under 35 U.S.C. 154(b) by 55 days.

(21) Appl. No.: 11/653,532

(22) Filed: Jan. 16, 2007

(65) Prior Publication Data

US 2007/0164812 A1 Jul. 19, 2007

Related U.S. Application Data

(60) Provisional application No. 60/779,153, filed on Mar. 2, 2006.

(30) Foreign Application Priority Data

Jan. 17, 2006 (IN) ..... 68/CHE/2006

(51) Int. Cl.
*G05F 1/10* (2006.01)

(52) U.S. Cl. ..... 327/540; 323/316

(58) Field of Classification Search ..... 327/538–543; 323/313, 316

See application file for complete search history.

(56) References Cited

U.S. PATENT DOCUMENTS 4,769,589 A 9/1988 Rosenthal
5,115,146 A 5/1992 McClure
5,159,217 A 10/1992 Mortensen et al.
5,187,389 A 2/1993 Hall et al.
5,212,412 A 5/1993 Atriss et al.
5,237,219 A 8/1993 Cliff
5,243,233 A 9/1993 Cliff
5,347,173 A 9/1994 McAdams
5,386,152 A 1/1995 Naraki
5,394,104 A 2/1995 Lee
5,463,348 A * 10/1995 Sarpeshkar et al. ..... 330/253
5,477,176 A 12/1995 Chang et al.
5,523,709 A 6/1996 Phillips et al.
5,528,182 A 6/1996 Yokosawa
5,563,799 A 10/1996 Brehmer et al.
5,564,010 A 10/1996 Henry et al.
5,565,811 A 10/1996 Park et al.

(Continued)

OTHER PUBLICATIONS

U.S. Appl. No. 11/653,533, Rao et al.

(Continued)

*Primary Examiner*—Lincoln Donovan
*Assistant Examiner*—Thomas J Hiltunen

(57) ABSTRACT

A circuit (200) can include a bias protection circuit (204) and a reference circuit (202). A bias protection circuit (204) can generate an internal power supply voltage (Vsuppi) from a higher device power supply (Vcch) with low voltage transistors and no resistors. A lower internal power supply voltage (Vsuppi) can be provided by buffer transistors (M5 and M6) that are biased according to limit section (206) that generates a bias voltage (biasn2) based on a threshold voltage drop and a feedback bias voltage (biasn1) from reference circuit (202).

19 Claims, 6 Drawing Sheets

U.S. PATENT DOCUMENTS 5,631,551 A * 5/1997 Scaccianoce et al. ..... 323/313
5,694,067 A 12/1997 Hull et al.
5,737,612 A 4/1998 Ansel et al.
5,801,580 A * 9/1998 Wu ..... 327/538
5,809,312 A 9/1998 Ansel et al.
5,821,787 A 10/1998 McClintock et al.
5,831,460 A 11/1998 Zhou
5,844,434 A 12/1998 Eschauzier
5,850,156 A 12/1998 Wittman
5,861,771 A * 1/1999 Matsuda et al. ..... 327/540
5,952,873 A * 9/1999 Rincon-Mora ..... 327/539
5,973,548 A 10/1999 Ukita et al.
6,016,074 A * 1/2000 Yamamori ..... 327/541
6,060,918 A 5/2000 Tsuchida et al.
6,094,041 A * 7/2000 Wachter ..... 323/315
6,118,266 A * 9/2000 Manohar et al. ..... 323/316
6,150,872 A * 11/2000 McNeill et al. ..... 327/539
6,157,244 A * 12/2000 Lee et al. ..... 327/539
6,204,724 B1 * 3/2001 Kobatake ..... 327/541
6,229,382 B1 * 5/2001 Kojima ..... 327/538
6,259,285 B1 7/2001 Woods
6,271,714 B1 8/2001 Shin
6,335,614 B1 1/2002 Ganti
6,344,771 B1 2/2002 Tobita
6,351,111 B1 2/2002 Laraia
6,356,064 B1 3/2002 Tonda
6,384,670 B1 5/2002 Eagar et al.
6,388,479 B1 5/2002 Gupta et al.
6,437,614 B1 8/2002 Chen
6,469,551 B2 10/2002 Kobayashi et al.
6,515,524 B1 2/2003 Sterrantino et al.
6,618,312 B2 9/2003 Cheung et al.
6,670,845 B1 * 12/2003 Fong ..... 327/541
6,677,787 B1 1/2004 Kumar et al.
6,677,810 B2 1/2004 Fukui
6,731,143 B2 5/2004 Kim
6,870,421 B2 * 3/2005 Abe ..... 327/539
6,879,194 B1 4/2005 Caldwell
7,030,668 B1 4/2006 Edwards
7,049,865 B2 5/2006 Parker
7,078,944 B1 7/2006 Jenkins
7,123,062 B2 10/2006 Do
7,126,391 B1 10/2006 Smith et al.
7,142,044 B2 11/2006 Sano
7,205,682 B2 4/2007 Kuramori
7,342,439 B2 3/2008 Hsiao
7,482,847 B2 1/2009 Suzuki
7,504,867 B2 3/2009 Choi et al.
7,535,286 B2 5/2009 Shimada
2004/0046532 A1 * 3/2004 Menegoli et al. ..... 323/273
2004/0189357 A1 9/2004 Kang et al.
2005/0093617 A1 * 5/2005 Min et al. ..... 327/538
2005/0140406 A1 6/2005 Rizzo et al.
2006/0001099 A1 * 1/2006 Motz ..... 257/355
2006/0001412 A1 * 1/2006 Fernald ..... 323/313
2006/0170407 A1 * 8/2006 Messager ..... 323/313

OTHER PUBLICATIONS

U.S. Appl. No. 11/653,540, Rao et al.
Ben G, Streetman, "Solid State Electronic Devices," Prentence-Hall Inc., 1972, ISBN: 0-13-822023-9; pp. 293, 299, 303; 5 pages.
USPTO Notice of Allowance for U.S. Appl. No. 10/857,039 dated Mar. 6, 2006; 4 pages.
USPTO Final Rejection for U.S. Appl. No. 10/857,039 dated Jan. 13, 2006; 5 pages.
USPTO Non-Final Rejection for U.S. Appl. No. 10/857,039 dated Sep. 14, 2005; 5 pages.
USPTO Miscellaneous Action for U.S. Appl. No. 10/857,039 dated Jun. 30, 2005; 3 pages.
USPTO Advisory Action for U.S. Appl. No. 10/857,039 dated Jun. 17, 2005; 4 pages.
USPTO Final Rejection for U.S. Appl. No. 10/857,039 dated Apr. 11, 2005; 5 pages.
USPTO Final Rejection for U.S. Appl. No. 10/857,039 dated Nov. 29, 2004; 4 pages.
USPTO Notice of Allowance for U.S. Appl. No. 10/889,245 dated Jun. 29, 2006; 6 pages.
USPTO Non-Final Rejection for U.S. Appl. No. 11/653,533 dated Jun. 24, 2009; 10 pages.
USPTO Advisory Action for U.S. Appl. No. 11/653,533 dated Mar. 23, 2009, 3 pages.
USPTO Final Rejection for U.S. Appl. No. 11/653,533 dated Jan. 8, 2009; 13 pages.
USPTO Non-Final Rejection for U.S. Appl. No. 11/653,533 dated Jun. 26, 2008; 12 pages.
USPTO Non-Final Rejection for U.S. Appl. No. 11/653,540 dated Aug. 25, 2008; 12 pages.
USPTO Notice of Allowance for U.S. Appl. No. 09/531,582 dated Aug. 30, 2001; 1 page.
USPTO Advisory Action for U.S. Appl. No. 09/531,582 dated Aug. 6, 2001; 1 page.
USPTO Final Rejection for U.S. Appl. No. 09/531,582 dated Jul. 16, 2001; 5 pages.
USPTO Non-Final Rejection U.S. Appl. No. 09/531,582 dated Feb. 28, 2001; 6 pages.
USPTO Notice of Allowance for U.S. Appl. No. 08/920,124 dated Apr. 14, 1998; 3 pages.
USPTO Notice of Allowance for U.S. Appl. No. 08/316,121 dated Sep. 16, 1997; 1 page.
USPTO Advisory Action for U.S. Appl. No. 08/316,121 dated Aug. 14, 1997; 1 page.
USPTO Final Rejection for U.S. Appl. No. 08/316,121 dated Apr. 25, 1997; 6 pages.
USPTO Non-Final Rejection for U.S. Appl. No. 08/316,121 dated Aug. 29, 1996; 9 pages.
USPTO Non-Final Rejection for U.S. Appl. No. 08/316,121 dated Jan. 26, 1996; 6 pages.
USPTO Notice of Allowance for U.S. Appl. No. 11/653,533 dated Nov. 16, 2009; 8 pages.
USPTO Notice of Allowance for U.S. Appl. No. 11/653,533 dated Feb. 19, 2010; 7 pages.
USPTO Notice of Allowance for U.S. Appl. No. 11/653,533 dated Feb. 19, 2010; 7 pages.

* cited by examiner

HIGH VOLTAGE TOLERANT BIAS CIRCUIT WITH LOW VOLTAGE TRANSISTORS

This application claims the benefit of U.S. Provisional Patent Application Ser. No. 60/779,153 filed on Mar. 2, 2006, the contents of which are incorporated by reference herein.

TECHNICAL FIELD

The present invention relates generally to integrated circuit devices that include self-biased voltage or current reference circuits, and more particularly to a buffer circuit for protecting a self-biased reference circuit from high voltage power supply levels.

BACKGROUND OF THE INVENTION

In many integrated circuit designs it can be desirable to provide a reference circuit. A reference circuit can provide a current and/or voltage at a generally known value. Reference circuits can have numerous applications, including but not limited to establishing a reference voltage to detect input signal levels, establishing a lower supply voltage to some section of a larger integrated circuit (e.g., memory cell array), establishing a reference voltage/current to determine the logic value stored in a memory cell, or establishing a threshold voltage for some other functions.

Reference circuits can be non-biased or self-biased. Non-biased reference circuits can rely on discrete voltage drop devices to arrive at a reference level. For example, a non-biased reference circuit can include resistor-diode (or diode connected transistor) arranged in series between a high supply voltage and a low supply voltage. A drawback to such approaches can be that a current drawn can be proportional to supply voltage. Thus, a higher supply voltage can result in a higher device current (ICC). This can be undesirable for low power applications.

Self-biased reference circuits can rely on transistor biasing to provide a reference current that is less variable (or essentially not variable) in response to changes in power supply voltage.

To better understand various features of the present invention, a conventional self-biased reference circuit with corresponding start-up circuitry will now be described.

FIG. 5 shows a conventional resistor-transistor divider circuit 500. Conventional resistor-transistor divider circuit 500 can receive power via a power supply voltage (Vcch) and a ground voltage (Vgnd). A resistor-transistor divider circuit 500 can include a first current mirror formed by p-channel metal-oxide-semiconductor (PMOS) transistors P51 and P52 and a second current mirror formed by n-channel MOS (NMOS) transistors N51 and N52. A bias point for such current mirrors can be established by a resistor R51.

Bias voltages Vbiasp1 and Vbiasn1 can be provided at gate-gate connections of transistors P51/P52 and N51/N52, respectively. An additional bias voltage Vbiasn2 can be generated by diode configured transistors N53 and N54 connected in series between a drain transistor P52 and ground voltage Vgnd. Similarly, an additional bias voltage Vbiasp2 can be generated by diode connected transistors P53 and P54 connected in series between a power supply voltage Vcch and the source of a transistor N55. Transistor N55 can be biased with voltage Vbiasn1.

Some or all of bias voltages Vbiasn1, Vbiasn2, VbiasP1 and VbiasP2 can be provided as input voltages for transistors (i.e., connected in a cascode fashion) in other analog circuit blocks. Such circuits can include current reference circuits, voltage reference circuits (including "band-gap" reference circuits), voltage regulator circuits, and low voltage detect circuits.

In addition to providing reference voltages at know levels, resistor-transistor divider circuit 500 can protect such other circuits from high voltage levels by acting as a buffer with respect to a high supply voltage Vcch.

A drawback to a conventional circuit like that shown in FIG. 5 can be undesirable variation in the bias voltages provided. In particular, a resistor-transistor divider circuit current can vary across operating and manufacturing conditions (i.e., process variations, operating voltage variations, and/or temperature variations (PVTs)).

Another drawback to a conventional circuit like that of FIG. 5 can be lack of flexibility and large circuit components needed for implementation. In particular, it can be difficult to optimize bias signals while at the same time providing the ability to handle a wide range of device power supply voltages (e.g., 1.6 V to 6.0 V). Further, to arrive at a small reference current Iref, a relatively large resistor R51 is needed.

Still further, in some cases a resistor-transistor divider circuit 500 may require special or additional protection transistors to be included as increased power supplies are used. In one conventional case, high voltage transistors can be formed with specialized manufacturing steps. A drawback to this approach is the added complexity to the manufacturing process. Adding transistors to accommodate a wide rage of power supply voltages can require a metal option and/or bond option to include/exclude such additional transistors as needed. This undesirably adds another manufacturing step to a device, increasing costs.

It would be desirable to arrive at a self-biased reference circuit that can operate at a wider range of power supply voltages without the drawback of the above conventional approaches.

It would also be desirable to arrive at a self-biased reference circuit that can operate at low current levels and yet not require large resistors.

It would also be desirable to arrive at a self-biased reference circuit that can buffer reference circuits from higher supply levels that does not include high voltage transistors.

DETAILED DESCRIPTION

Various embodiments of the present invention will now be described in detail with reference to a number of drawings. The embodiments show circuits and methods for a bias protection circuit and corresponding reference circuit that can operate over a wide range of power supply voltages. Further, a bias protection circuit can be composed entirely of transistors, thus eliminating the need for large resistors. Further, the transistors can be low voltage transistors.

Figure 1:
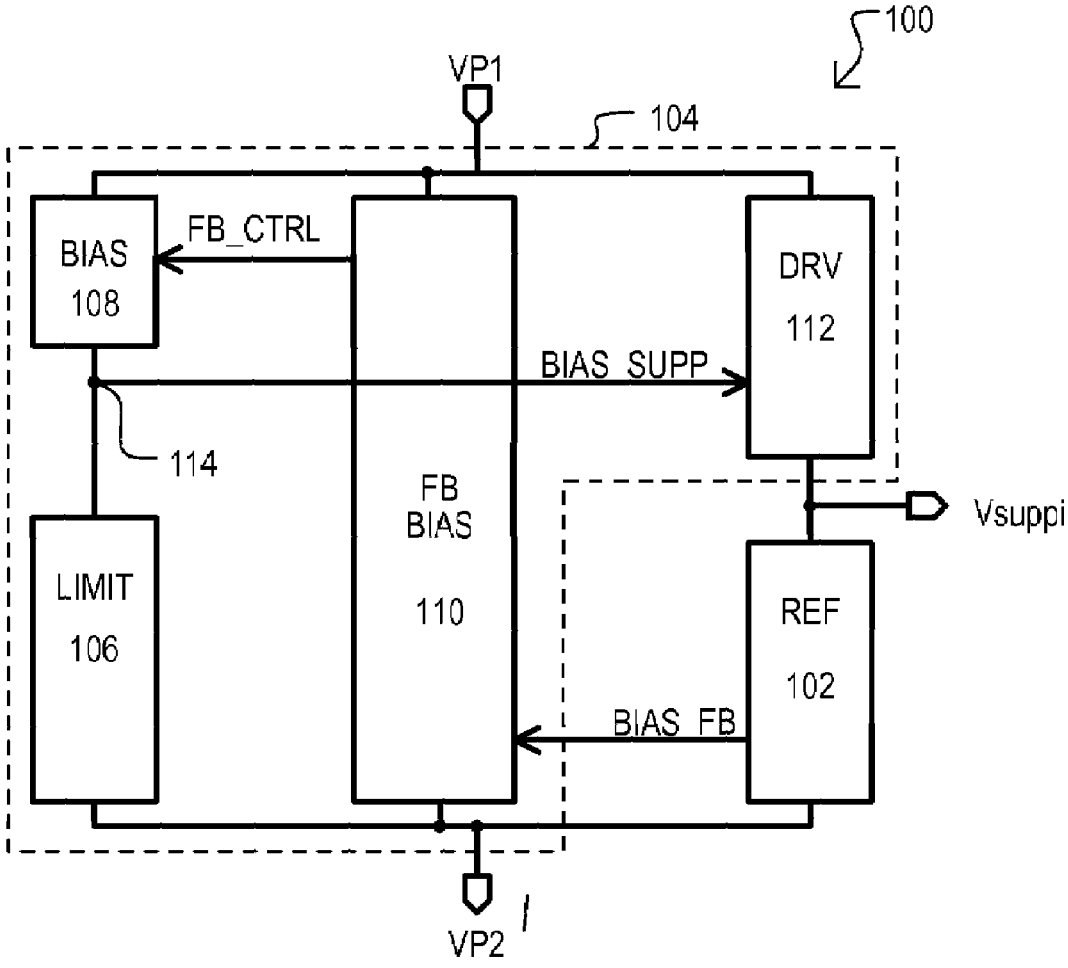
FIG. 1 is a block schematic diagram of a circuit according to a first embodiment of the present invention.

A circuit according to a first embodiment is set forth in FIG. 1, and designated by the general reference character 100. A circuit 100 can include a reference circuit 102 and a bias protection up circuit 104. A reference circuit 102 can be a self-biased reference circuit that can provide one or more reference values (e.g., current or voltage) Vref based on an internal power supply voltage Vsuppi generated by bias protection circuit 104. In addition, a reference circuit 102 can provide a feedback bias voltage BIAS_FB to bias protection circuit 104.

As but two of the many possible examples, a reference circuit 102 can include a beta multiplier type current reference circuit, a band-gap type reference circuit, or a combination thereof.

A bias protection circuit 104 can be situated between a device power supply VP1 and a reference voltage VP2, and can include a number of circuit sections. In the example of FIG. 1, such circuit sections can include a limit section 106, a limit bias section 108, bias feedback section 110, and a drive section 112. A limit section 106 can generate a supply bias voltage BIAS_SUPP that can control drive section 112. That is, according to a BIAS_SUPP voltage, a drive section 112 can generate an internal power supply voltage Vsuppi that is between voltages VP1 and VP2. Preferably, a limit section 106 can enable a current path to reference voltage VP2 once a potential at a supply bias node 114 exceeds a predetermined limit.

A bias feedback section 110 can receive a feedback bias voltage BIAS_FB, and in response, generate a feedback control voltage FB_CTRL. A limit bias section 108 can provide a current to limit section 106 according to feedback control voltage FB_CTRL.

Figure 2A:
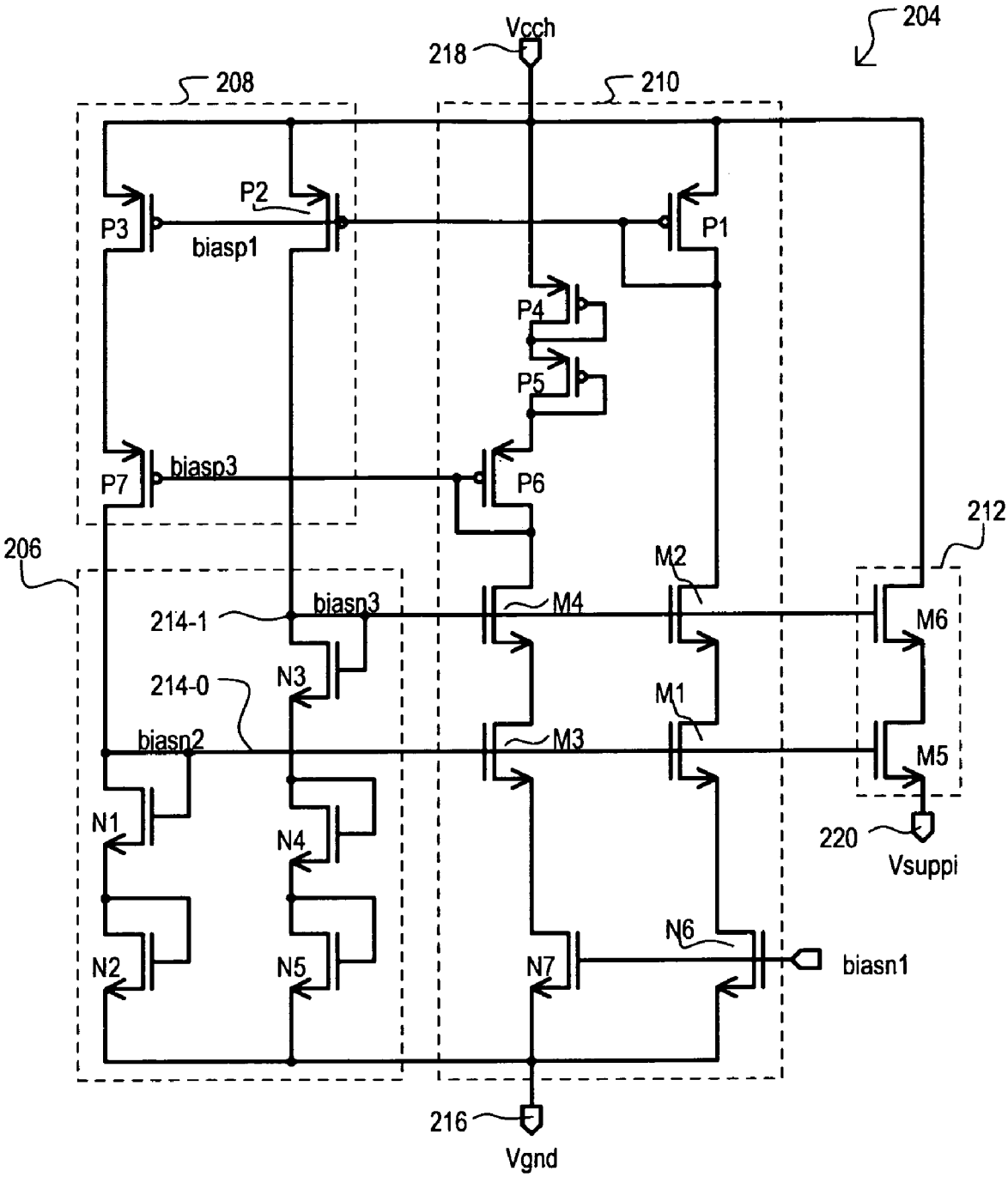
FIGS. 2A and 2B are schematic diagrams, of a circuit according to a second embodiment of the present invention.
Figure 2B:
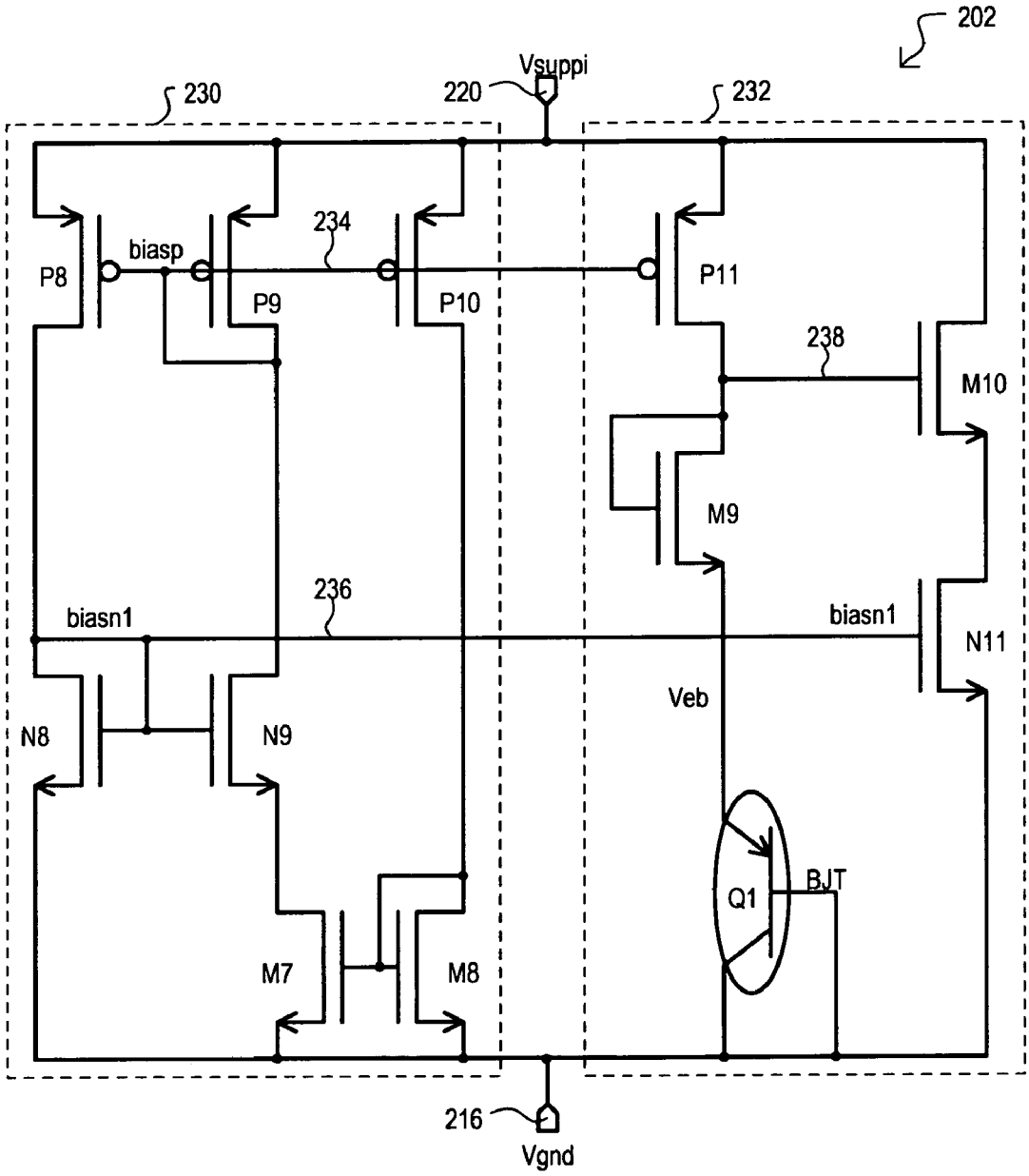

A second, more detailed embodiment of the present invention is shown in FIGS. 2A and 2B. FIG. 2A shows a bias protection circuit 204. FIG. 2B shows a reference circuit 202.

A bias protection circuit 204 can include many of the circuit sections like those shown in FIG. 1. Accordingly, like sections are referred to by the same reference character but with the first digit being a "2" instead of a "1".

In the bias protection circuit 204 of FIG. 2A, a limit section 206 can provide two bias voltages, "biasn2" at a first bias node 214-0 and a "biasn3" at a second bias node 214-1. A bias voltage biasn2 can be generated according to two n-channel insulated gate field effect transistors (IGFETs) N1 and N2, both connected in a diode configuration and in series between first bias node 214-0 and a low power supply node 216. A second bias voltage biasn3 can be generated according to three n-channel IGFETs N3-N5 all connected in a diode configuration and in series between second bias node 214-1 and low power supply node 216.

Preferably, n-channel transistors N1-N5 can be low voltage transistors. A low voltage transistor can be one of a majority of transistors in an integrated circuit designed to withstand a predetermined voltage level across its terminal. In one embodiment, a low voltage transistor is a transistor that is not designed to withstand a highest received power supply voltage (Vcch). In another embodiment, a low voltage transistor is a transistor that is not designed to withstand a potential greater than 6.0 volts, preferably no greater than 5.0 volts, even more preferably no greater than 3.5 volts.

Still further, n-channel transistors N1-N5 can have typical complementary metal oxide semiconductor (CMOS) threshold voltages. In one embodiment, threshold voltages can be no less than about 0.5 volts, even more preferably no less than 0.25 volts, even more preferably, no less than 200 mV.

In one design, transistors N1 and N2 can both have width/length (W/L) dimensions of about 0.5/6 microns. Transistors N3 to N5 can have W/L dimensions of about 0.5/1.0 microns.

A bias feedback section 210 can include a first feedback bias leg formed by a p-channel IGFET P1, protection transistor M2, protection transistor M1, and bias feedback transistor N6. Transistor P1 can have a source coupled to a device power supply node 218 and a drain and gate coupled to the drain of transistor M2. A gate of transistor P1 can also be connected to the gates of other p-channel transistors P2 and P3 of limit bias section 208 in a current mirror configuration. Transistors M1 and M2 can have source-drain paths connected in series. A gate of transistor M2 can receive bias voltage biasn3 and a gate of transistor M1 can receive bias voltage biasn2. Bias feedback transistor N6 can have a source-drain coupled between a source of transistor M1 and low power supply node 216, and a gate that receives a feedback voltage biasn1 from a self-biased reference circuit 202 (shown in FIG. 2B).

In the above arrangement, transistor N6 can establish a bias level based on feedback bias voltage biasn1. Transistors M1 and M2 can provide this biasing level to transistor P1, while at the same time providing high voltage protection to both devices P1 and N6 due to the bias voltages biasn2 and biasn3 in their respective gates.

A p-channel transistor P1 can have a typical CMOS threshold voltage. In one embodiment, threshold voltages can be no more than about −0.5 volts, even more preferably no more than about −0.25 volts, even more preferably, no more than about −200 mV. Further, in one example, a transistor P1 can have W/L dimensions of about 4/4 microns.

An n-channel transistor N6 can be a low voltage transistor, as described above with respect to transistors N1-N5. Further, in an even more detailed embodiment, transistor N6 can have a W/L dimension of about 16/1 microns.

Transistors M1 and M2 can be low threshold voltage n-channel IGFETs. As but one example, transistors M1 and M2 can have threshold voltages less than those of other n-channel transistors within the circuit (i.e., transistors N1-N7). In another example, transistors M1 and M2 can have a threshold voltage that varies from a low power supply level (Vgnd) by no more than about 200 mV. Even more particularly, a low power supply voltage (Vgnd) can be ground (0 volts), and transistors M1 and M2 can have threshold voltages in the general range of about +100 mV to about −100 mV. Still further, transistors M1 and M2 can be "native" devices: transistors that are not subject to any threshold voltage implant/diffusion steps to raise its threshold voltage. In one example, transistors M1 and M2 can have W/L dimensions of about 1/1 microns.

A bias feedback section 210 can also include a second feedback bias leg formed by p-channel IGFETs P4-P6, protection transistors M3 and M4, and bias feedback transistor N7. Transistors P4 and P5 can be connected in a diode configuration, and in series, between a device power supply voltage node 218 and a source of transistor P6. Transistor P6 can have a drain and gate coupled to the drain of transistor M4. A gate of transistor P6 can also be connected to a gate of transistor P7 of limit bias section 208.

In the above arrangement, transistors N7 can establish a bias level based on feedback bias voltage biasn1. At the same time, transistors P4 to P6 can provide a three p-channel threshold voltage (Vtp) drop to generate a bias voltage biasp3. Transistors M3 and M4 can provide high voltage protection to device N7.

P-channel transistors P4-P6 can have typical CMOS threshold voltages, as noted above with respect to transistor P1. In one arrangement, transistors P4-P6 can have W/L dimensions of about 1/5 microns.

An n-channel transistor N7 can be a low voltage transistor, as described above with respect to transistors N1-N5. Further, in an even more detailed embodiment, transistor N7 can have a W/L dimension of about 16/1 microns.

Transistors M3 and M4 can be low threshold voltage n-channel IGFETs as described above with respect to transistors M1 and M2. In one example, transistors M3 and M4 can have W/L dimensions of about 1/1 microns.

A limit bias section 208 can provide bias currents to limit section 206 with p-channel IGFETs P2, P3 and P7. In particular, transistor P2 can have a source coupled to device power supply node 218, a drain coupled to second bias node 214-1, and a gate that receives bias voltage biasp1.

Transistor P3 and P7 can have source-drain paths arranged in series between device power supply node 218 and a first bias node 214-0. A gate of transistor P3 can receive bias voltage biasp1 and a gate of transistor P7 can receive bias voltage biasp3.

P-channel transistors P2, P3 and P7 can be low voltage transistors, having typical CMOS threshold voltages, as noted above with respect to transistor P1. In one arrangement, transistors P2 and P3 can have W/L dimensions of about 4/4 microns, while transistor P7 has W/L dimensions of about 4/0.3.

A drive section 212 can include transistors M5 and M6 having source-drain paths arranged in series with one another between a device power supply node 218 and an internal power supply node 220. A gate of transistor M6 can receive bias voltage biasn3 and a gate of transistor M5 can receive a bias voltage biasn2.

Transistors M5 and M6 can be low threshold voltage n-channel IGFETs as described above with respect to transistors M1 and M2. Preferably, transistors M6 and M7 can be relatively large transistors with respect to the other transistors of bias protection circuit 204 in order to provide sufficient current to reference circuits. In one very particular example, W/L dimension of transistors M6 and M7 can be about 160/0.7 microns.

Bias voltages biasn2 and biasn3 can ensure that an internal power supply voltage Vsuppi provided at node 220 is a stable, protected voltage for use by a reference circuit.

In operation, a bias protection circuit 204 can generate an internal power supply voltage (Vsuppi) at node 220 having a level of 2Vtn−Vtnat, where Vtn is a threshold voltage of transistors N1 and N2 (and preferably transistors N3 to N7), while Vtnat can be a "low" threshold voltage of transistor M5 (and preferably transistors M1-M4 and M6). Such an internal power supply voltage can be buffered according to transistor M5.

Further, a bias protection circuit 204 can provide this limited voltage internal supply (Vsuppi) while receiving a wide range of power supply voltages. As but one example, a power supply voltage Vcch can be in the range of 1.6 volts to 6.0 volts, resulting in an internal power supply voltage Vsuppi of about 1.6 volts to 2.1 volts.

By providing a "stepped down" internal power supply voltage Vsuppi to a reference circuit (e.g., 202), such a reference circuit can operate with precision low voltage devices to provide internal reference voltages for use by other circuits.

It is noted that the embodiment of FIG. 2A includes no resistors, allowing for a compact and low power consumption circuit. It is also noted that the embodiment of FIG. 2A does not include any high voltage transistors.

FIG. 2B is a schematic diagram showing one particular embodiment of a reference circuit 202 that can operate with a bias protection circuit like that shown in FIG. 2A. The particular reference circuit 202 of FIG. 2B can be connected between an internal power supply node 220 and a low power supply node 216. A reference circuit 202 can include a current reference circuit 230 and a voltage reference circuit 232. A current reference circuit 230 can include a first current mirror formed by p-channel IGFETs P8-P10 and a second current mirror formed by n-channel IGFETs N8 and N9. A bias level for the circuit can be established by bias circuit formed with transistors M7 and M8. Transistors P8 to P10 can have sources connected to internal power supply node 220 and commonly connected gates. In addition, a gate of transistor P9 can be connected to its drain.

Common gates of transistors P8 to P10 can be formed at a first reference bias node 234 that can carry a reference bias potential biasp.

P-channel transistors P8-P10 can have typical CMOS threshold voltages, as noted above with respect to transistor P1. In one arrangement, transistor P8 can have W/L dimensions of about 4/2 microns, transistor P9 can have W/L dimensions of about 16/2 microns, and transistor P10 can have W/L dimensions of about 32/2 microns.

An n-channel transistor N8 can have a drain and gate connected to a drain of transistor P8 and a source coupled to a reference power supply node 216. Transistor N9 can have a drain connected to a drain of transistor P9 and a gate connected to a gate of transistor N8. Common gates of transistors N8 and N9 can be formed at a second reference bias node 236 that can carry a reference bias potential biasn1, that can be provided to bias protection circuit, like 204 shown in FIG. 2A.

N-channel transistors N8 and N9 can have typical CMOS threshold voltages, as noted above with respect to transistor N6. In one arrangement, transistor N8 can have W/L dimensions of about 16/1 microns and transistor N9 can have W/L dimensions of about 64/1 microns.

Transistors M7 and M8 can have sources commonly connected to a low power supply node 216. Transistor M7 can have a drain connected to the source of transistor N9 and a gate coupled to the gate of transistor M8. Transistor M8 can have a gate and drain connected to the drain of transistor P10.

Transistors M7 and M8 can be low threshold voltage n-channel IGFETs as described above with respect to transistors M1 and M2. In one very particular example, W/L dimension of transistors M6 and M7 can be about 0.45/200 and 0.45/400 microns, respectively.

A voltage reference circuit 232 can be a "band-gap" type reference circuit that includes a p-channel current supply IGFET P11, an n-channel reference IGFET M10, an n-channel bias IGFET N11, a proportional to absolute temperature generator M9, and a pnp bipolar device/structure Q1.

Transistor P11 can have a source connected to an internal power supply node 220, a gate coupled to the first bias node 234 and a drain coupled to a voltage reference node 238. P-channel transistor P11 can have typical CMOS threshold voltages, as noted above with respect to transistor P1, and in one arrangement, can have W/L dimensions of about 64/2 microns.

Transistor M10 can have a source connected to internal power supply node 220 and a gate connected to voltage reference node 238. Transistor N11 can have a drain connected to the source of transistor M10, a gate connected to second bias node 236, and a source connected to a reference voltage node 216.

N-channel transistors M10 can be a low threshold voltage as noted above with respect to transistor M1, and N11 can have typical CMOS threshold voltages, as noted above with respect to transistor N6.

Transistor M9 can be connected in a diode fashion between voltage reference node 238 and an emitter of pnp device Q1. Transistors M9 can be a low threshold voltage n-channel IGFET as described above with respect to transistors M1 and M2. In one very particular example, W/L dimensions of transistor M9 can be about 0.45/200 microns. Device Q1 can have an emitter connected to the source of transistor M9, and a base and collector connected to reference voltage node 216.

It is noted that the various devices of reference circuit 202 shown in FIG. 2B can be low voltage devices. Such an arrangement can be possible due to the "stepped" level of an internal power supply voltage Vsuppi provided at internal power supply node 220. As a result, precise reference voltage/current references can be produced as the circuit 202 need not be designed to handle large power supply voltages (e.g., voltages greater than 2.5 volts).

In the above arrangement shown in FIGS. 2A and 2B, bias protection circuit 204 can establish a biasing current based on a bias voltage biasn1 generated within reference circuit 202. In turn, reference circuit 202 receives an internal power supply level Vsuppi from bias protection circuit 204. However, such a feedback loop can avoid triggering positive feedback as a self-biased reference circuit 202 can have a "beta multiplier" type reference circuit. Such circuits can provide a reference current that can be independent of power supply.

Figure 3:
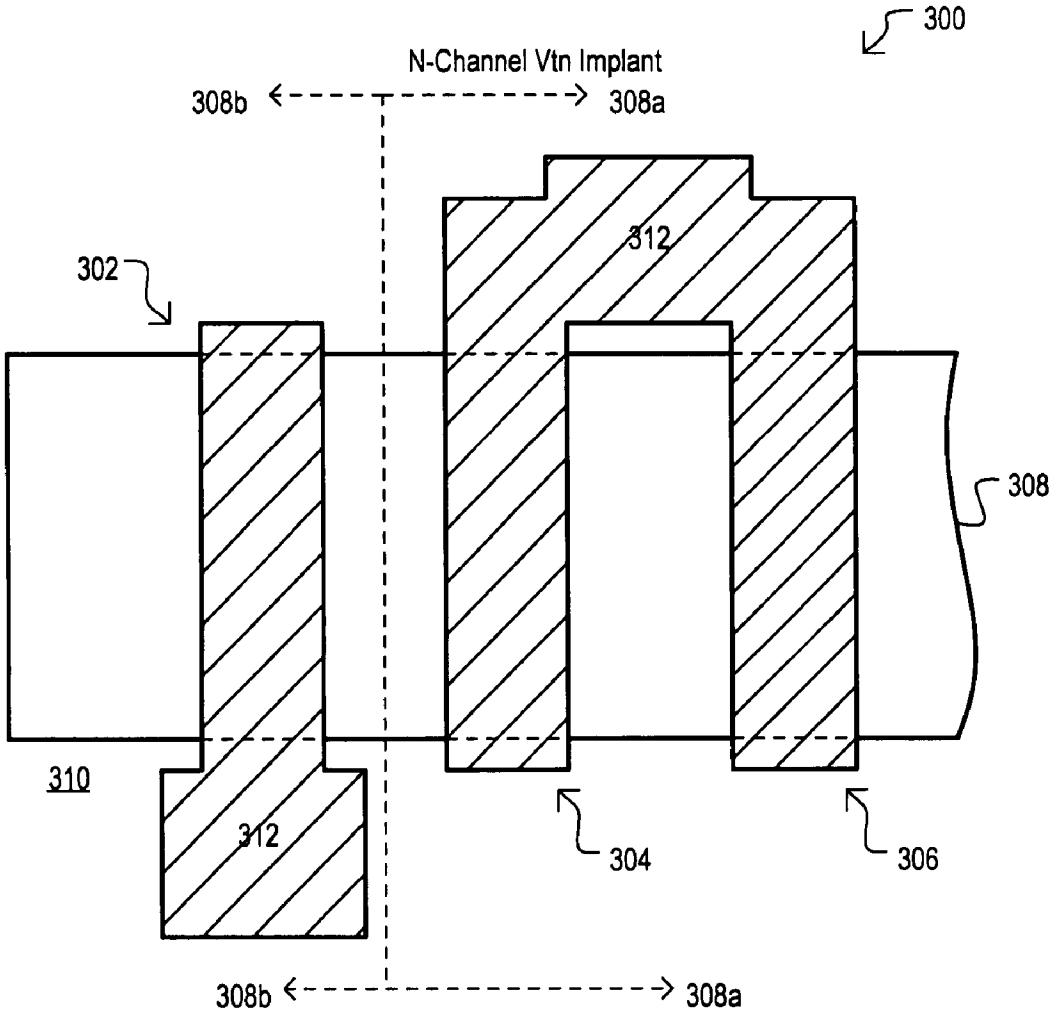
FIG. 3 is a top plan view showing the formation of a "native" transistor that can be included in the above embodiments.

As noted above, in particular embodiments, a bias protection circuit 204 and/or reference circuit 202 can include "native" n-channel transistors. FIG. 3 shows one very particular example of how such devices can be formed.

FIG. 3 is top plan view of n-channel transistors at a gate level. A layout 300 can include a "native" device 302 and two "standard" devices 304 and 306 formed in an active area 308 surrounded by isolation 310.

One portion 308*a* of active area 308 can be subject to a threshold implant step that can raise a threshold voltage of transistors 304 and 306 (prior to the formation of gates 312 and/or sources/drains). Another portion 308*b* of active area 308 can be isolated from such a manufacturing step.

Of course, native devices can be formed in their own active areas, and need not share an area with other non-native devices.

Figure 4:
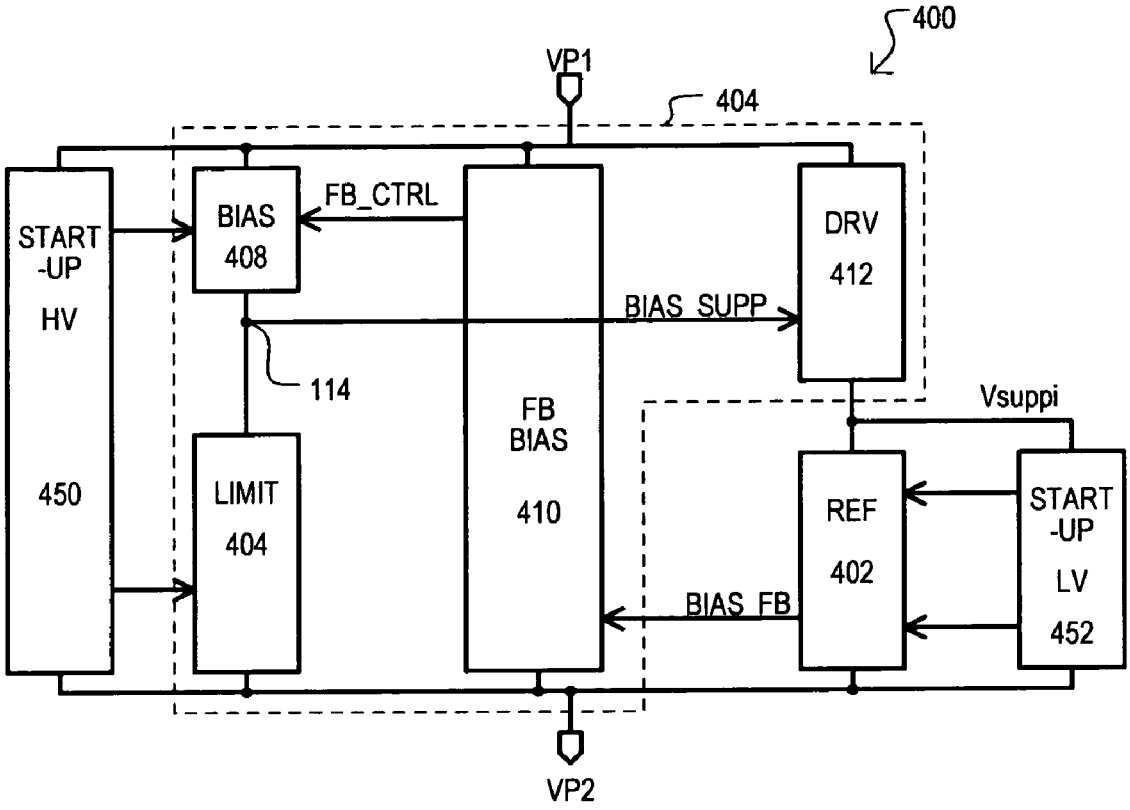
FIG. 4 is a block schematic diagram of an embodiment that includes start-up circuits.
Figure 5:
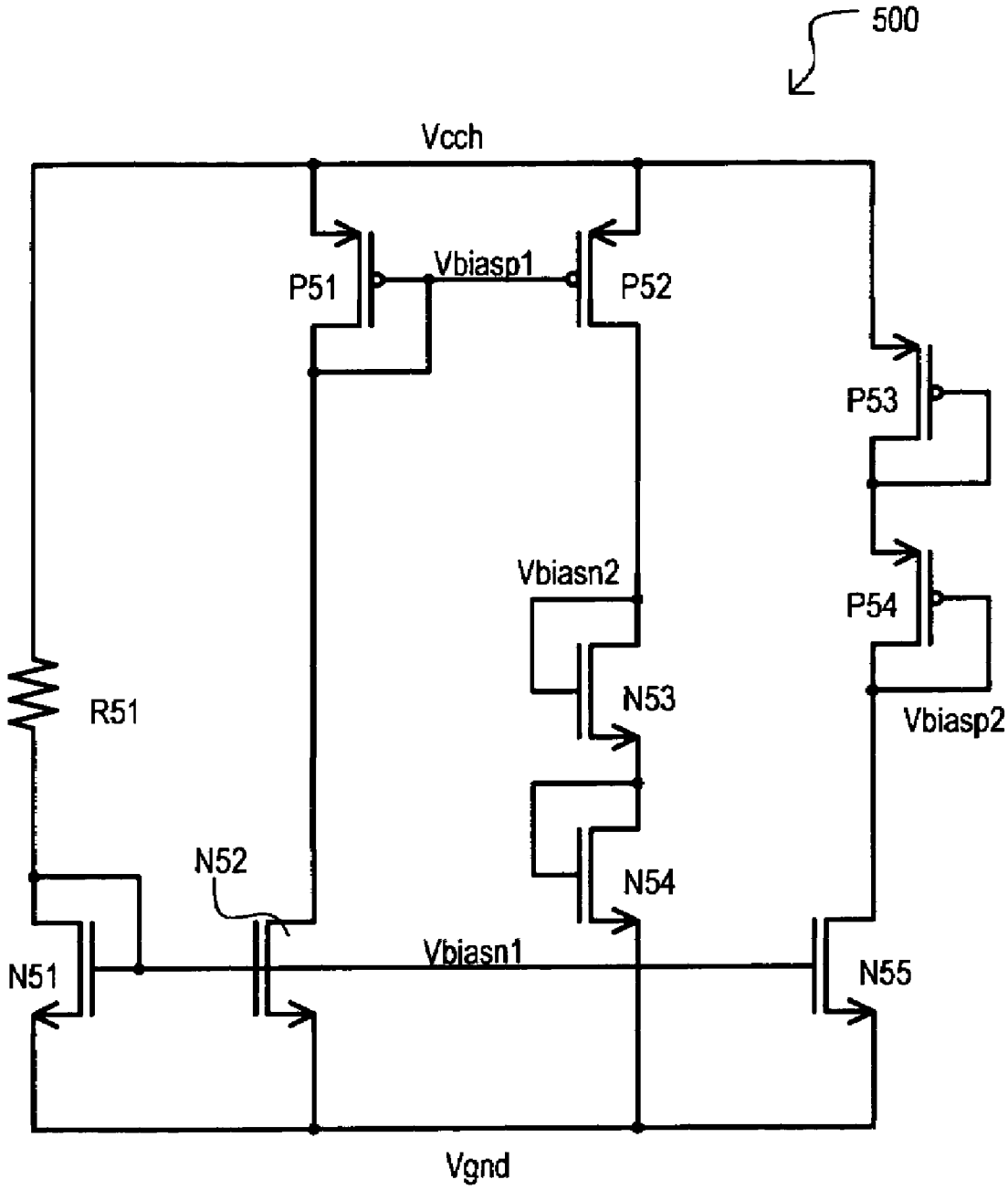
FIG. 5 (BACKGROUND ART)
FIG. 5 is a schematic diagram of a conventional resistor-transistor divider bias circuit.

It is understood that in the embodiments shown in FIGS. 1, 2A and 2B, bias nodes internal to such circuits can be coupled to start-up circuits. One such arrangement is shown in FIG. 4. FIG. 4 is a block schematic diagram showing a circuit 400 that includes some of the same general components as those shown in FIGS. 1 and 2A/2B. To that extent, like sections are referred to by the same reference character but with the first digit being a "4" instead of a "1" or "2".

FIG. 4 also includes a first start-up circuit 450 and a second start-up circuit 452. According to known techniques, a start-up circuit 450 can place bias nodes within a bias protection circuit 404 at predetermined stable levels in the event of a start-up operation. Similarly, a second start-up circuit 452 can place bias nodes within a reference circuit 402. In the particular arrangement shown, first start-up circuit 450 can be a "high voltage" start-up circuit that is coupled between a device power supply voltage VP1 and a reference voltage VP2. In contrast, second start-up circuit 452 can be a "low voltage" start-up circuit that is coupled between an internal power supply voltage Vsuppi a reference voltage VP2.

One particular example of a start-up circuit is shown in co-pending patent application Ser. No. 10/653,533 titled LOW POWER BETA MULTIPLIER START-UP CIRCUIT AND METHOD, by inventors T. V. Chanakya Rao et al. and filed on Jan. 16, 2007. It is noted that start-up circuits can include essentially any self-biased circuit that gives a desired reference (current/voltage) independent of external voltage.

It is understood that the embodiments of the invention may be practiced in the absence of an element and or step not specifically disclosed. That is, an inventive feature of the invention can be elimination of an element.

Accordingly, while the various aspects of the particular embodiments set forth herein have been described in detail, the present invention could be subject to various charges, substitutions, and alterations without departing from the spirit and scope of the invention.

What is claimed is:

1. A voltage bias circuit, comprising:

a self-biased reference circuit disposed between an internal power supply node and a reference node and comprising bias circuits that provide at least one reference value based on a stable bias potential on at least one internal node;

a bias protection circuit coupled between a device power supply node and the reference node, the bias protection circuit comprising a drive circuit that enables a controllable impedance path between the device power supply node and the internal power supply node according to a potential on at least a first supply bias voltage node, a limit circuit that enables a first current path between the first supply bias voltage node and the reference node when the first supply bias voltage node exceeds a first predetermined limit with respect to the potential at the reference node, and a feedback bias circuit that includes a first bias feedback current path coupled between the device power supply node and the reference node that is controlled according to the potential at the one internal node of the self-biased reference circuit; and a limit supply circuit that provides a current to the limit circuit according to the current provided by the first bias feedback path.

2. The voltage bias circuit of claim 1, wherein:

the drive circuit comprises at least a first buffer transistor having a source-drain path coupled between the internal power supply node and the device power supply node and a gate coupled to the first supply bias voltage node.

3. The voltage bias circuit of claim 2, wherein:

the reference node receives a reference voltage; and the first buffer transistor has a threshold voltage that varies from the reference voltage by no more than about 150 mV.

4. The voltage bias circuit of claim 1, wherein:

the limit circuit further enables a second current path between a second supply bias voltage node and the reference node when the second supply bias voltage node exceeds a second predetermined limit with respect to the potential at the reference node, the second predetermined limit being different from the first predetermined limit.

5. The voltage bias circuit of claim 4, wherein:

the drive circuit comprises a first buffer transistor having a source-drain path coupled between the internal power supply node and the device power supply node and a gate coupled to the first supply bias voltage node, and a second buffer transistor having a source-drain path in series with the first buffer transistor between the internal power supply node and the device power supply node and a gate coupled to the second supply bias voltage node.

6. The voltage bias circuit of claim 5, wherein:
the reference node receives a reference voltage; and
the first buffer transistor and second buffer transistors have threshold voltages that vary from the reference voltage by no more than about 150 mV.

7. The voltage bias circuit of claim 1, wherein:
the limit circuit comprises a first limit path coupled between the supply bias voltage node and the reference node, the first limit path including at least two diode connected transistors arranged in series with one another.

8. The voltage bias circuit of claim 7, wherein:
the limit circuit further comprises a second limit path arranged in parallel to the first limit path between a second supply bias voltage node and the reference node, the second limit path including at least three diode connected transistors arranged in series with one another.

9. The voltage bias circuit of claim 1, wherein:
the first bias feedback patch comprises
a first feedback current supply transistor having a source-drain path coupled to the device power supply node, and
at least a first feedback control transistor having a source-drain path coupled in series with the source-drain path of the first feedback current supply transistor, the feedback control transistor having a gate coupled to the one internal node of the self-biased reference circuit.

10. The voltage bias circuit of claim 9, wherein:
the feedback bias circuit further comprises a second bias feedback current path coupled between the device power supply node and the reference node in parallel with the first bias feedback current path that is controlled according to the potential at the one internal node of the self-biased reference circuit.

11. The voltage bias circuit of claim 10, wherein:
the second bias feedback path comprises
a plurality of second feedback current supply transistors, each diode connected and having source-drain path coupled in series to the device power supply node, and at least a second feedback control transistor having a source-drain path coupled in series with the source-drain paths of the second feedback current supply transistors, the second feedback control transistor having a gate coupled to the bias node of the self-biased reference circuit.

12. The voltage bias circuit of claim 1 wherein:
the self-biased reference circuit comprises a beta multiplier circuit.

13. The voltage bias circuit of claim 12, wherein
the self-biased reference circuit further comprises a band gap reference circuit.

14. A method of generating reference voltages with a high voltage power supply and low voltage transistors, comprising:
establishing a first supply bias voltage with at least one series of diode connected transistors coupled to a reference voltage node and a first current supply transistor biased according to a reference bias voltage;
biasing a first supply transistor coupled to a device power supply node according to the first supply bias voltage to generate an internal power supply voltage less than the device power supply voltages, including coupling the supply bias voltage to an n-channel transistor having a threshold voltage of less than 150 mV;
powering a self bias reference circuit with the internal power supply voltage to generate the reference bias voltage at a level between the internal power supply voltage and the reference node;
establishing a second supply bias voltage with at least a second series of diode connected transistors coupled to the reference voltage node and a second current supply transistor biased according to the reference bias voltage; and
biasing a second supply transistor coupled in series with the first supply transistor according to the second supply bias voltage.

15. The method of claim 14, wherein:
the powering the self-bias reference circuit comprises providing the internal power supply voltage to a beta multiplier circuit.

16. The method of claim 14, wherein:
the powering the self-bias reference circuit comprises providing the internal power supply voltage to a band-gap reference circuit.

17. A voltage bias circuit, comprising:
a self-biased reference circuit disposed between an internal power supply node and a reference node and comprising bias circuits that provide at least one reference value based on a stable bias potential on at least one internal node; and
a bias protection circuit coupled between a device power supply node and the reference node, the bias protection circuit comprising:
a drive circuit that enables a controllable impedance path between the device power supply node and the internal power supply node according to a potential on at east a first supply bias voltage node, the drive circuit comprising at least a first buffer transistor having a gate coupled to the first supply bias voltage node and a threshold voltage that varies from the reference voltage by no more than about 150 mV,
a limit circuit that enables a fist current path between the first supply bias voltage node and the reference node when the first supply bias voltage node exceeds a first predetermined limit with respect to the potential at the reference node,
a feedback bias circuit that comprises first and second bias feedback current paths both coupled between the device power supply node and the reference node and controlled according to the potential at the one internal node of the self-biased reference circuit, and
a limit supply circuit that provides a current to the limit circuit according to the current provided by the first bias feedback path.

18. The voltage bias circuit of claim 17, wherein:
the limit circuit further enables a second current path between a second supply bias voltage node and the reference node when a second supply bias voltage node exceeds a second predetermined limit with respect to the potential at the reference node; and
the drive circuit comprises
the first buffer transistor having a source-drain path coupled between the internal power supply node and the device power supply node, and
a second buffer transistor having a source-drain path in series with the first buffer transistor between the internal power supply node and the device power supply node and a gate coupled to the second supply bias voltage node.

19. The voltage bias circuit of claim 18, wherein:
the second buffer transistor has a threshold voltage that varies from the reference voltage by no more than about 150 mV.

* * * * *